US007339125B2

(12) United States Patent
Day

(10) Patent No.: US 7,339,125 B2
(45) Date of Patent: Mar. 4, 2008

(54) SAFETY SWITCH OPERATING MECHANISM

(75) Inventor: Anthony Charles Barrington Day, Manchester (GB)

(73) Assignee: EJA Limited, Wigan (GB)

( * ) Notice: Subject to any disclaimer, the term of this patent is extended or adjusted under 35 U.S.C. 154(b) by 0 days.

(21) Appl. No.: 11/494,956

(22) Filed: Jul. 28, 2006

(65) Prior Publication Data

US 2007/0023263 A1 Feb. 1, 2007

(30) Foreign Application Priority Data

Jul. 29, 2005 (GB) ..... 0515583.3

(51) Int. Cl.
*H01H 27/00* (2006.01)

(52) U.S. Cl. ..... 200/43.04; 200/43.07; 200/334

(58) Field of Classification Search ..... 200/17 R, 200/43.04–43.07, 61.62, 334, 329
See application file for complete search history.

(56) References Cited

U.S. PATENT DOCUMENTS 4,531,032 A 7/1985 Murata
5,777,284 A * 7/1998 Mohtasham ..... 200/43.04
5,868,243 A * 2/1999 Bachle ..... 200/334
5,894,116 A * 4/1999 Da Dalt ..... 200/43.04
5,959,270 A 9/1999 Wecke et al.
6,013,881 A * 1/2000 Hall et al. ..... 200/43.04
6,194,674 B1 2/2001 Fukui
6,483,053 B2 * 11/2002 Kajio et al. ..... 200/43.07
6,720,508 B2 * 4/2004 Moriyama et al. ..... 200/200
6,872,898 B2 * 3/2005 Mohtasham ..... 200/43.01

FOREIGN PATENT DOCUMENTS

EP 1 274 107 A 1/2003
JP 2003 045294 A 2/2001

* cited by examiner

*Primary Examiner*—Michael A Friedhofer
(74) *Attorney, Agent, or Firm*—Keith M. Baxter; William R. Walbrun

(57) ABSTRACT

A safety switch operating mechanism having an engagement mechanism mechanically linked to a plunger and arranged to receive an actuator such that insertion of the actuator into the engagement mechanism moves the plunger to a first position and removal of the actuator from the engagement mechanism moves the plunger to a second position. The safety switch operating mechanism having a resilient member which engages with the plunger and resiliently resists movement of the plunger from the first position to the second position. The engagement of the resilient member with the plunger resists inadvertent removal of the actuator from the engagement mechanism.

19 Claims, 3 Drawing Sheets

SAFETY SWITCH OPERATING MECHANISM

CROSS-REFERENCE TO RELATED APPLICATIONS

This application claims priority under 35 U.S.C. §119 to British Patent Application GB0515583.3 filed on Jul. 29, 2005 and the entirety of which is incorporated herein.

BACKGROUND OF THE INVENTION

The present invention relates to a safety switch operating mechanism.

Safety switches are well known, and are typically used to prevent access to for example dangerous electromechanical machinery when that machinery is in operation. In an conventional arrangement the safety switch is mounted on a door post of a machinery guard, and an actuator for the safety switch is mounted on a corresponding door. When the door is closed the actuator engages with the safety switch, which in turn closes an electrical contact that allows power to be supplied to the machinery. This arrangement ensures that power can only be supplied to the machinery when the guard door is shut. When the guard door is opened, the actuator disengages from the safety switch, thereby opening the electrical contact and cutting off the supply of power to the machinery.

In some instances a problem has arisen in that an operating mechanism of the safety switch may allow an actuator to be too easily removable from the safety switch. In one situation, vibration of the electromechanical machinery may be sufficient to cause the actuator to jump out of the safety switch, allowing the door to swing open and interrupting the supply of power to the electromechanical machinery. Since this immediately interrupts operation of the electromechanical machinery, it will be appreciated that it reduces the efficiency of the operation of the machinery. An engineer or other operator must close the door of the housing, so that the actuator engages with the safety switch, thereby allowing power to be supplied to the electromechanical machinery before it can resume operation.

The present invention is directed to overcome or substantially mitigate the above disadvantage.

SUMMARY OF THE INVENTION

According to a first aspect of the invention there is provided a safety switch operating mechanism comprising an engagement mechanism mechanically linked to a plunger, the engagement mechanism being arranged to receive an actuator such that insertion of the actuator into the engagement mechanism moves the plunger to a first position and removal of the actuator from the engagement mechanism moves the plunger to a second position, wherein the safety switch operating mechanism further comprises a resilient member which engages with the plunger, and which resiliently resists movement of the plunger from the first position to the second position and thereby resiliently resists removal of the actuator from the engagement mechanism.

The invention is advantageous because it reduces the likelihood of the actuator accidentally being removed from the engagement mechanism.

Preferably, the resilient member comprises a planar member formed from a resilient material.

Preferably, the planar member is configured such that it may flex about a fulcrum point, the fulcrum point being located partway along the planar member.

Preferably, the location of the fulcrum point is adjustable using an adjustment member.

Preferably, the adjustment member comprises a block, the block being configured to provide an abutment point which presses against the planar member, thereby establishing the fulcrum point.

Preferably, the orientation of the block is adjustable to allow the abutment point to be located at different positions on the planar member.

Preferably, the block is provided with a plurality of faces, at least some of which provide different abutment points.

Preferably, the block is provided with four or more faces.

Preferably, the block may be rotated to allow the different abutment points to press against the planar member.

Preferably, the block is rotatably mounted and is connected to an adjustment device.

Preferably, the block may be inverted, to allow a given abutment point to press against a different position on the planar member.

Preferably, the planar member is L-shaped.

Preferably, the resilient member is provided with a recess which engages with the plunger.

Preferably, the engagement mechanism is a rotatably mounted cam member.

Preferably, the cam member is provided with a cam surface which pushes the plunger against the resilient member during removal of the actuator from the engagement mechanism.

Preferably, the plunger is one of a plurality of plungers.

BRIEF DESCRIPTION OF THE DRAWINGS

A specific embodiment of the invention will now be further described, by way of example only, with reference to the accompanying drawings, in which.

DETAILED DESCRIPTION OF THE PREFERRED EMBODIMENT

Figure 1:
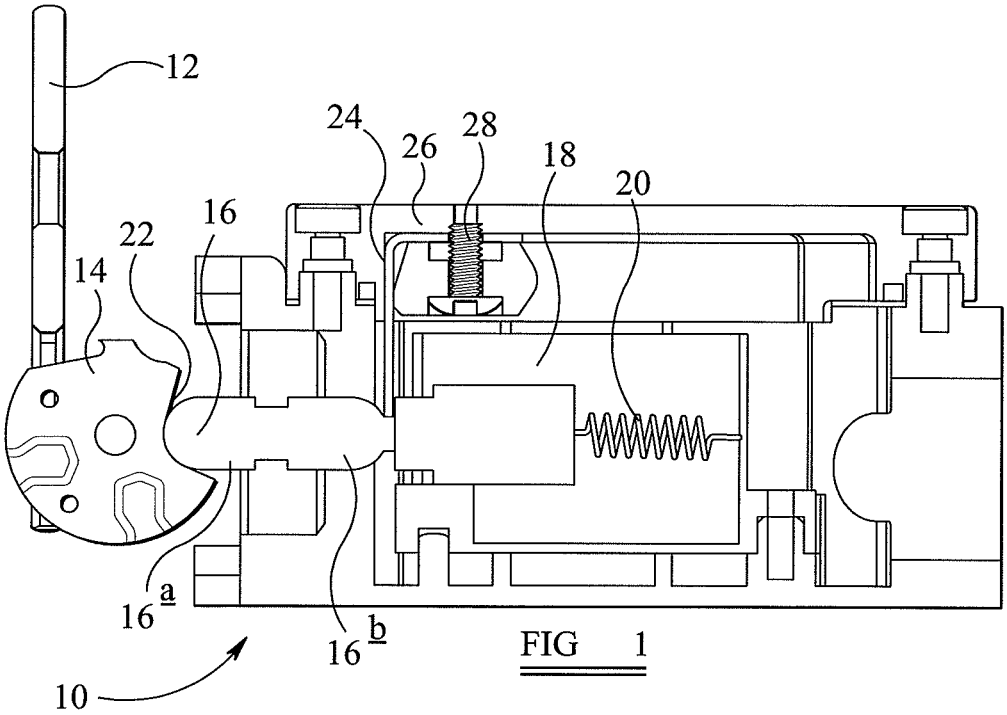
FIG. 1 shows a safety switch operating mechanism which embodies the invention, with an actuator in situ.

FIG. 1 shows a safety switch 10 for use on a door or gate of a guard for electromechanical machinery. The safety switch 10 requires insertion of an actuator 12 for electrical contacts to be made to allow the machinery to operate. The electrical contacts, which are not shown in FIG. 1, are included in the power supply circuit for the machinery such that opening the electrical contacts will interrupt the supply of power to the machinery. The safety switch 10 may be, for example, mounted on a guard door post and the actuator 12 mounted on the guard door, so that closing of the guard door inserts the actuator into the safety switch.

The safety switch 10 has a body (not shown in FIG. 1) provided with an aperture or a pair of apertures through which the actuator 12 is insertable to act on an engagement mechanism comprising a rotatably mounted cam member 14. The cam member 14 is shaped to cause linear movement of a plunger 16 to operate the electrical contacts (not shown). The plunger 16 passes into an inner housing 18 which contains the electrical contacts. An end of the plunger 16 which is furthest from the cam assembly 14 is connected by a helical spring 20 to a wall of the inner housing 18. The helical spring 20 resiliently biases the plunger 16 towards the cam member 14. Although the plunger is illustrated as comprising two parts 16*a*, 16*b*, it will be appreciated that the plunger may alternatively be formed as a single entity (or may have any other suitable form).

In FIG. 1 the actuator 12 has been inserted into the safety switch 10 and has moved the cam member 14 to a first rest position. When the cam member 14 is in the first rest position, a recess 22 in the cam member is aligned with the plunger 16. This allows the helical spring 20 to push the plunger 16 outwards, to the position shown in FIG. 1. When the plunger 16 is in this position, the electrical contacts which allow power to be supplied to the electromechanical machinery are closed.

Above the plunger 16, a resilient member 24 is mounted on a housing 26 of the safety switch 10. The resilient member 24 is planar, and is arranged in an L-shape. One limb of the resilient member 24 is fixed to the housing 26 by means of a bolt 28 which passes through a block 30. The other limb of the resilient member 24 depends from the housing 26, a free end of the resilient member locating in a neck of the plunger 16.

Figure 2:
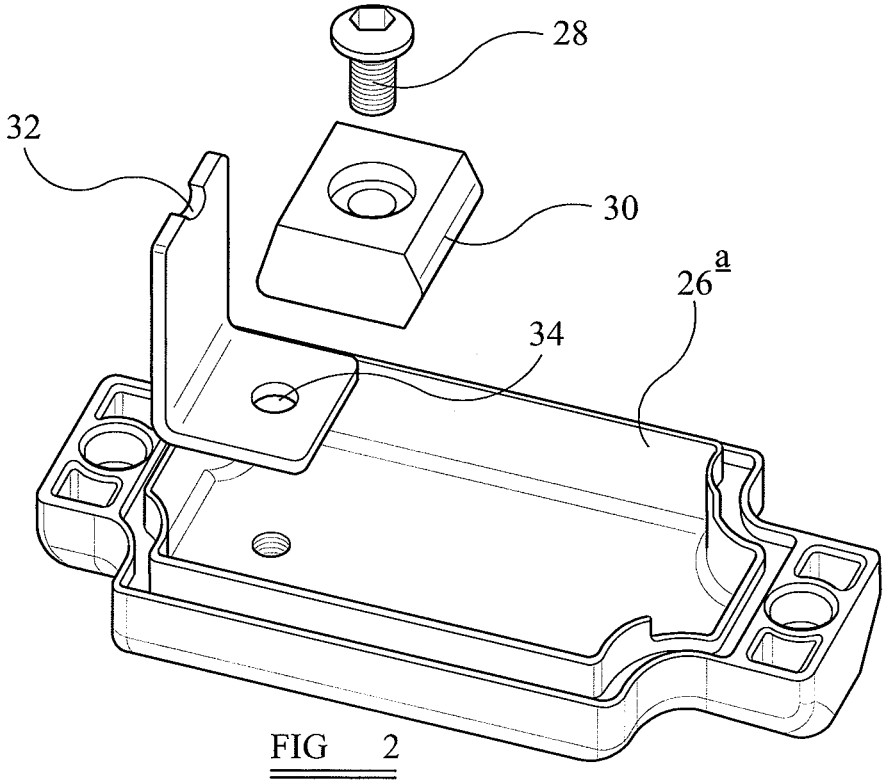
FIG. 2 shows components of the safety switch operating mechanism of FIG. 1.

FIG. 2 is a perspective exploded view which shows the resilient member 24, the bolt 28, the block 30, and a lid 26*a* of the housing 26. From FIG. 2 it can be seen that the resilient member 24 is provided with a recess 32 at the end of one limb, the recess being positioned such that it locates over the plunger 16 when the safety switch 10 is assembled. The other limb of the resilient member 24 is provided with an aperture 34 which aligns with a corresponding aperture 36 in the block 30, thereby allowing the resilient member and the block to be securely fixed to the lid 26*a* of the housing 26 using the bolt 28.

The construction of the resilient member 24 is such that when it is in an equilibrium configuration (i.e. when no forces are being applied to it), it depends directly downwards as shown in FIG. 1. When the resilient member 24 is in this configuration it does not apply any force to the plunger 16.

Figure 3:
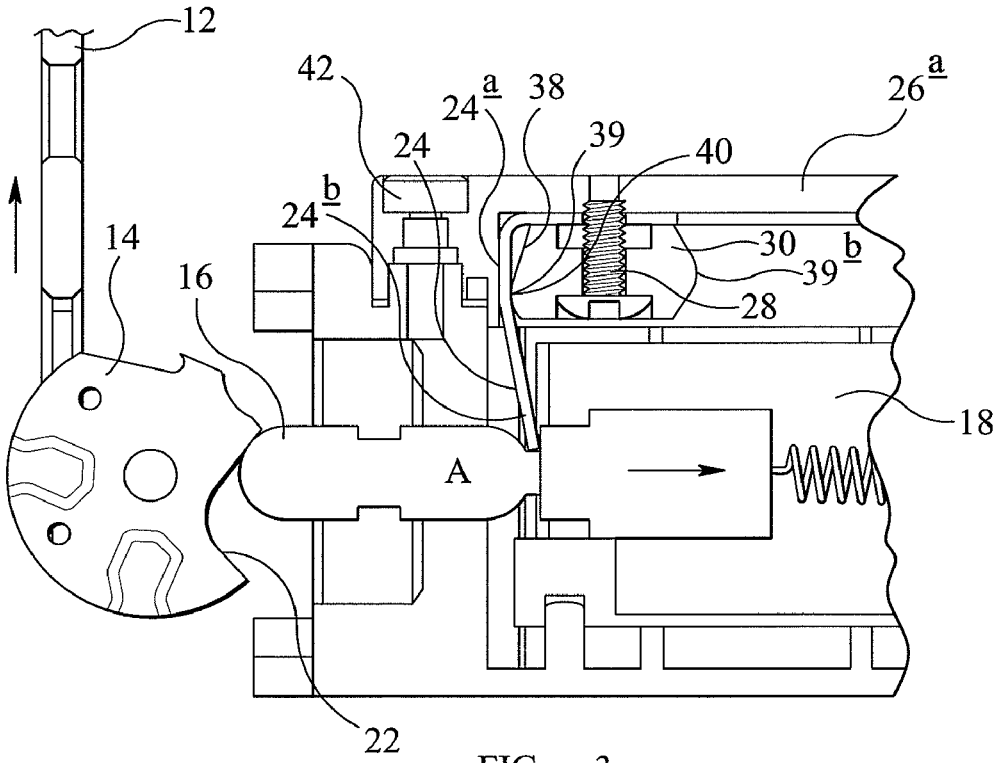
FIG. 3 shows the safety switch operating mechanism of FIG. 1 with the actuator being removed.

FIG. 3 illustrates the removal of the actuator 12 from the cam member 14. The cam member 14 must be rotated through approximately 90 degrees before the actuator 12 can be removed from the safety switch 10. The recess 22 provided in the cam member 14 is curved such that during rotation of the cam member the plunger 16 is pushed towards the inner housing 18 by the cam member. Movement of the plunger 16 in this direction opens the electrical contacts (not shown) of the safety switch. The plunger 16 pushes against the resilient member 24, which resiliently bends as shown in FIG. 3. The resilient member 24, when bent in this manner, applies force to the plunger 16 which pushes the plunger 16 towards the cam member 14. The plunger 16, by pushing against the cam member 14, resists rotation of the cam member in the clockwise direction, which in turn resists removal of the actuator 12 from the safety switch 10. The resilient member 24 thus provides a resistive force which acts against the withdrawal of the actuator 12 from the safety switch 10. This is advantageous because it reduces the likelihood of the actuator 12 being accidentally removed from the safety switch 10 (for example due to vibration of the guard upon which the safety switch and actuator are mounted).

The force applied by the resilient member 24 which acts against removal of the actuator 12 depends upon the material properties of the resilient member, its thickness, and also the length of that part of the resilient member which generates the force. The resilient member 24 may for example be formed from stainless steel or some other suitable metal or other material. The resilient member 24 may be for example between 0.25 and 0.4 millimetres thick.

Referring to FIG. 3, it can be seen that an upper portion 24*a* of the resilient member 24 remains static when the plunger 16 is pushed towards the inner housing 18, whereas a lower portion 24*b* of the resilient member bends towards the inner housing. The length of the lower portion 24*b* of the resilient member is dictated by the block 30. The block 30 is provided with a tapered face 38, a lowermost end of the tapered face 38 providing an abutment point 39 which presses the resilient member 24 against an inner surface of the housing 26. The block 30 thereby provides a fulcrum 40 below which the resilient member 24 is allowed to bend (i.e. the lower portion of 24*b* of the resilient member).

Figure 4:
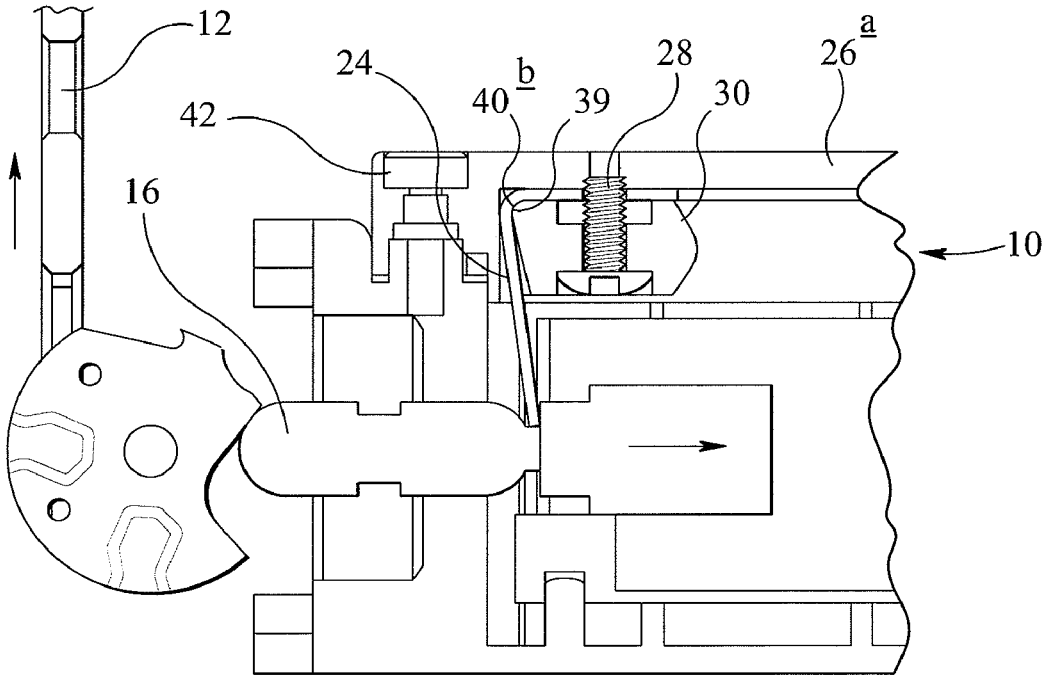
FIG. 4 shows a variation to the safety switch operating mechanism of FIG. 1.

Referring to FIG. 4, the block 30 may be inverted such that the abutment point 39, and hence the fulcrum 40*b* below which the resilient member 24 is allowed to bend, is located further away from the plunger 16. The lengthening of the resilient member 24 which results has the effect of reducing the force that is generated by the resilient member when the plunger 16 pushes against it. This is, turn reduces the amount of force that is required in order to remove the actuator 12 from the safety switch 10.

The orientation of the block may be selected to be as shown in FIG. 3 or as shown in FIG. 4, depending upon the specific requirements of the application for which the safety switch 10 is used.

In order to invert the block 30, the lid 26*a* of the housing 26 is removed by unbolting lid securing bolts 42. The bolt 28 is then unbolted from the lid 26 to allow the block 30 and the resilient member 24 to be disassembled, as shown in FIG. 2. The block is positioned in the desired orientation, and is secured together with the resilient member 24 using the bolt 28. The lid 26 is then replaced and secured using the securing bolts 42.

It will be appreciated that in addition to the block 30 being inverted, the block may also be rotated. Referring to FIG. 3, it can be seen that a right hand side of the block 30 is curved such that it provides an abutment point 39*b* halfway between an uppermost and a lowermost surface of the block. Rotating the block through 180 degrees, for example following disassembly as shown in FIG. 2, will result in the abutment point 39*b* pushing against the resilient member 24. The part of the resilient member 24 which is allowed to bend will thus be midway between the lengths shown in FIGS. 3 and 4, with the result that an intermediate force is applied by the resilient member when the actuator 12 is removed from the safety switch 10.

The resilient member 24 may be arranged to apply a restraining force, which resists removal of the actuator 12 from the safety switch 10, of for example between 10 and 100 Newtons, depending upon the orientation of the block 30.

Figure 5A:
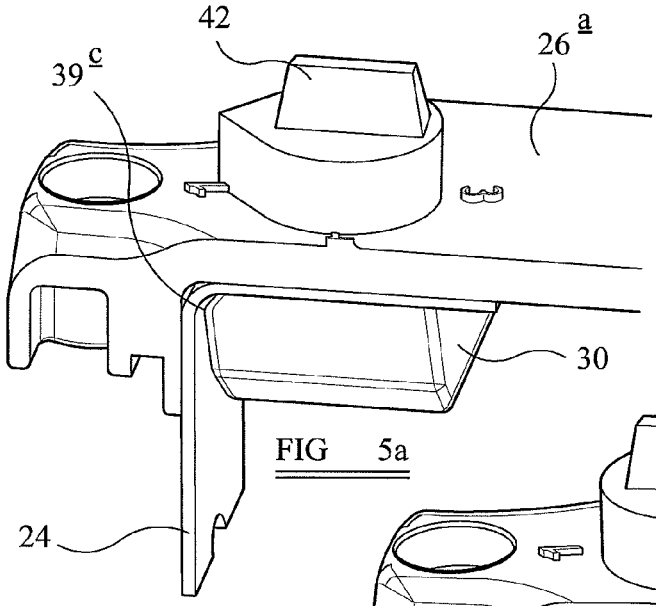
FIGS. 5 and 6 show part of an alternative embodiment of the invention.
Figure 5B:
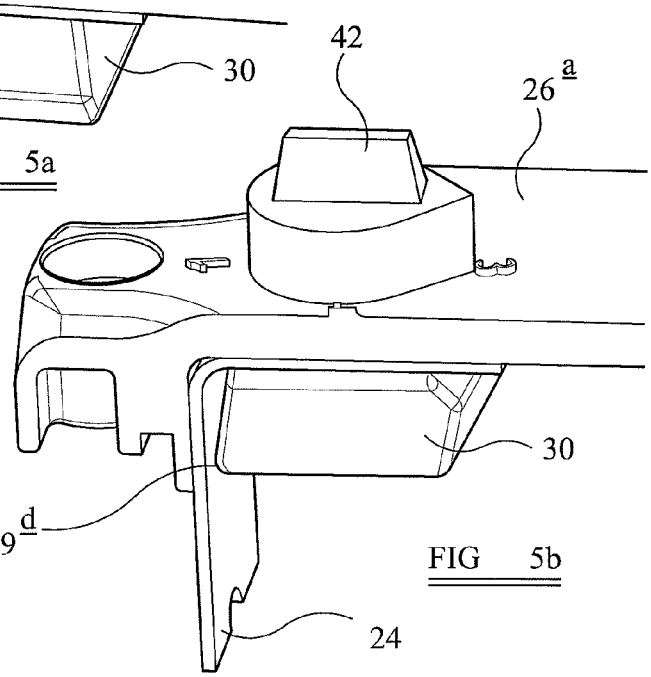
Figure 6:
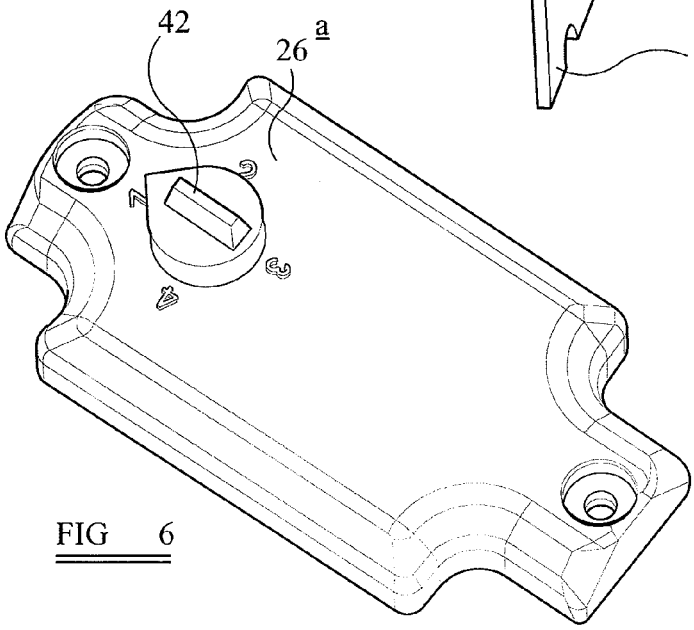

An alternative embodiment of the invention is shown in FIGS. 5 and 6. Like reference numerals are used in FIGS. 5 and 6 for elements which correspond with those shown in FIGS. 1 to 4. FIG. 5*a* shows in section a perspective view of a lid 26*a* of a housing of a safety switch. A resilient member 24 and a block 30 are secured to the lid 26*a* by a bolt (not visible) which passes through the lid and is secured in a selecting knob 42. The selecting knob 42 is rotatable, and is arranged such that when it rotates it causes the block 30 to rotate with it. This is advantageous because it allows different abutment points 39 to be pushed against the resilient member 24. For example, in FIG. 5*a* an abutment point 39*c*, which is part way down the block 30 is pushed against the resilient member 24, whereas in FIG. 5*b* an abutment point 39*d* which is at the bottom of the block 30 is pushed against the resilient member 24.

Alternative abutment points may be provided at different heights on other faces of the block 30. If desired, the block may be provided with more faces, for example the block may be hexagonal in cross-section.

Corners between faces of the block 30 may be rounded off, to allow the block to be easily rotated using the selecting knob 42.

FIG. 6 is a perspective view of the lid 26*a* and the selecting knob 42. As shown in FIG. 6, the lid 26*a* may be provided with indicators, and the selecting knob 42 may be pointed at one side, such that a user can easily determine which face of the block 30 is pushed against the resilient member 24.

It will be appreciated that the plunger 16 referred to above may be one of a pair (or more) of plungers that act in unison.

Although the resilient member 24 is illustrated as an L-shaped member in the described embodiments, it will be appreciated that it may take other suitable forms. For example, the resilient member may be straight rather than L-shaped. An L-shape is preferred because this allows more convenient attachment of the resilient member 24 to the housing 26 of the safety switch 10.

The electrical contacts provided in the safety switch 10 may be any suitable type of mechanically actuated contacts. One form of safety switch to which the embodiment of the invention could be applied is the MTGD2 switch (proprietary trademark) sold by EJA Engineering of Wigan, United Kingdom.

Although the description of the safety switch 10 refers to it being provided on a guard of electromechanical machinery, it will be appreciated that the safety switch may be used for any other suitable purpose. For example, the safety switch 10 may be provided on a guard of an electrical circuit or circuits.

Although the actuator 12 has been described as being provided on a guard door, it will be appreciated that the actuator 12 may be provided in any other suitable location. For example, the actuator 12 may be located on a chain near to the safety switch 10. Where this is the case the safety switch 10 may be arranged to lock the guard door when the actuator 12 is inserted into the safety switch 10.

What is claimed is:

1. A safety switch operating mechanism comprising:

an engagement mechanism mechanically linked to a plunger and arranged to receive an actuator such that insertion of the actuator into the engagement mechanism moves the plunger to a first position and removal of the actuator from the engagement mechanism moves the plunger to a second position; and a resilient member which engages the plunger and resiliently resists movement of the plunger from the first position to the second position to resist removal of the actuator from the engagement mechanism, the resilient member being supported such that a biasing force of the resilient member is adjustable.

2. The safety switch operating mechanism of claim 1 wherein the resilient member comprises a planar member formed from a resilient material.

3. The safety switch operating mechanism of claim 2 wherein the planar member is constructed to flex about a fulcrum point located along the planar member.

4. The safety switch operating mechanism of claim 3 further comprising an adjustment member constructed to adjust the location of the fulcrum point.

5. The safety switch operating mechanism of claim 4 wherein the adjustment member comprises a block having at least one abutment point positioned proximate the planar member to define the fulcrum point.

6. The safety switch operating mechanism of claim 5 wherein the block includes a plurality of abutment points and orientation of the block relative to the planar member positions one of the plurality of abutment points proximate the planar member.

7. The safety switch operating mechanism of claim 5 wherein the block includes a plurality of faces and is rotatable relative to the planar member.

8. The safety switch operating mechanism of claim 5 wherein the block is invertable from a first position to a second position to allow the at least one abutment point to press against a first location and a second location of the planar member, respectively.

9. The safety switch operating mechanism of claim 1 wherein the resilient member is L-shaped.

10. The safety switch operating mechanism of claim 1 further comprising a recess formed in an end of the resilient member constructed to engage the plunger.

11. The safety switch operating mechanism of claim 1 wherein the engagement mechanism is a cam rotatably attached to the safety operating switch.

12. The safety switch operating mechanism of claim 11, wherein the cam further comprises a cam surface constructed to push the plunger against the resilient member during removal of the actuator from the engagement mechanism.

13. A switch system comprising:

a housing;

a plunger slidably connected to the housing for opening and closing an electrical circuit;

a cam for moving the plunger between a first position and a second position; and a resilient member for engaging the plunger and providing an adjustable bias force to the plunger to retain the plunger in one of the first position and the second position.

14. The switch assembly of claim 13 wherein the housing further comprises an inner housing and a lid for connecting to the inner housing and the resilient member is connected to the lid and the plunger is connected to the inner housing.

15. The switch assembly of claim 13 wherein the resilient member is a deflectable plate.

16. The switch assembly of claim 13 further comprising a block connectable to the housing in a plurality of positions and each position defines a bias force of the resilient member.

17. The switch assembly of claim 16 wherein the block is rotatably connected to the housing, the block being rotatable by at least one of manipulation of a selector knob and connecting the block to the housing in alternate positions.

18. A safety switch assembly comprising:

a plunger attached to a body;

a cam engaged with the plunger;

an actuator connected to the cam and constructed to move the cam between a first position and a second position;

a plate spring connected to the body and engaged with the plunger to retain a location of the cam; and an adjuster engaged with the plate spring and constructed to adjust a length of a deflectable portion of the plate spring.

19. The safety switch assembly of claim 18 wherein the adjuster includes a plurality of sides and each of the plurality of sides has an abutment point that is a different distance from an end of the plate spring that engages the plunger.

* * * * *